US006527617B1

(12) United States Patent
Capozzi et al.

(10) Patent No.: US 6,527,617 B1
(45) Date of Patent: Mar. 4, 2003

(54) METHOD OF MAKING A PERSONALIZED STUFFED TOY

(75) Inventors: Lee Capozzi, Ridgefield, NJ (US); Gary Lee Holcomb, Belleaire Bluffs, FL (US)

(73) Assignee: Dan-Dee International, Ltd., Jersey City, NJ (US)

( * ) Notice: Subject to any disclaimer, the term of this patent is extended or adjusted under 35 U.S.C. 154(b) by 0 days.

(21) Appl. No.: 10/247,881

(22) Filed: Sep. 19, 2002

(51) Int. Cl.[7] ..... A63H 3/02
(52) U.S. Cl. ..... 446/369; 53/469
(58) Field of Search ..... 53/258, 390, 452, 53/469; 446/369, 385, 486

(56) References Cited

U.S. PATENT DOCUMENTS 4,063,402 A 12/1977 Washburn et al.
4,681,555 A * 7/1987 Natiw ..... 446/327
5,182,844 A 2/1993 Honda
5,182,845 A 2/1993 Dean
5,498,194 A * 3/1996 Altier ..... 446/369
5,885,128 A 3/1999 Blaustein et al.
5,989,095 A 11/1999 Wotton
6,048,248 A * 4/2000 Ritchey ..... 446/71
6,109,196 A 8/2000 Silber

* cited by examiner

*Primary Examiner*—Jacob K. Ackun
(74) *Attorney, Agent, or Firm*—Amster, Rothstein & Ebenstein

(57) ABSTRACT

A method of making a personalized stuffed toy for a purchaser by providing an unstuffed toy and stuffing it through an opening in the presence of a purchaser thereof, thereby to cause the same to assume the shape of the stuffed toy and then delivering the personalized stuffed toy to the purchaser. The resultant stuffed toy has a safety barrier between the stuffing and the closed opening.

25 Claims, 5 Drawing Sheets

METHOD OF MAKING A PERSONALIZED STUFFED TOY

BACKGROUND OF THE INVENTION

The present invention relates to a stuffed toy and a method of making the same, and more particularly to a personalized and safe stuffed toy for a purchaser and a method for making the same.

Stuffed animals and toys are typically formed by filing a sewn fabric skin or body with a resilient material such as polyester-cellulose fibers alone or along with polystyrene beads or other filler materials, creating a three-dimensional soft and resilient representation of an animal or other toy. Most stuffed toys are manufactured by first sewing the skin together from multiple pieces of fabric, leaving an opening through which stuffing may later be inserted. Where two or more pieces of fabric are sewn together, they are sewn such that the bulky portion of the seam faces the inside of the finished skin. Therefore, the skin is inside out so that unfinished edges of the pieces of fabric from which the skin is formed are all located on the inside of the finished stuffed toy. Once the pieces of fabric are sewn together into a finished skin or body, the skin or body is turned right side out so that the best and smooth finished side of the fabric faces outwardly and the rough seams are hidden. Next, stuffing is inserted through the stuffing opening until the interior volume of the "container" defined by the inside of the skin is substantially full of the stuffing material, giving the stuffed toy a resilient three-dimensional shape, much like the inflation of a balloon.

In small scale or custom manufacturing, the plush toy may be hand stuffed. That is, handfuls of stuffing may be pushed through the stuffing opening in the skin or body. In larger scale manufacturing, some type of stuffing injection tube is often used to insert stuffing into the skin or body. An injection tube is inserted through the stuffing opening and the stuffing material is then injected or pumped through the tube into the interior of the stuffed toy.

When the stuffed toy is sufficiently filled with stuffing material, the stuffing opening must be closed to give the stuffed toy an acceptable appearance and to prevent leakage of the stuffing material. Traditionally, the stuffing opening is sewn closed from the outside of the skin using a sewing machine. This approach has several disadvantages. First, the resulting seam generally has a wound-like appearance That is, sewing the opening shut from the outside creates a ridge or thick-type scar which is readily apparent on the skin of the finished stuffed toy. It is desirable to eliminate this wound-like ridge or thick-type scar to improve the appearance and feel of stuffed toys. Second, closing the stuffing opening by sewing from the outside of the skin after the stuffing material is inserted can be a relatively time-consuming procedure and a costly labor expense. Also, special equipment such as sewing materials and/or a sewing machine are required to close the opening. Third, should the sewn closure of the stuffing opening be or become defective (i.e., wholly or partially open) during use, the stuffing material may escape from the interior volume of the stuffed toy and become accessible to a child in the vicinity of the stuffed toy. The stuffed materials may be unpleasant when ingested or otherwise directly contacted by a child. Accordingly, for the various reasons stated above and others, sewing as a method of closing the stuffing opening has fallen into disfavor. See U.S. Pat. No. 6,109,196.

Children have a natural affinity to stuffed toys because of the soft, warm, cuddly feel of the stuffed toy. A current marketing trend is to build upon this natural affinity by developing a special one-to-one personal relationship between the child and the stuffed toy. For example, a "birth certificate" may be provided, identifying the stuffed toy by a name selected by the child purchaser and identifying the latter as a parent of the stuffed toy. (Similarly, broken toys are not repaired, but rather sent to a "toy hospital.") While the "birth certificate" concept may appeal to children with verbal skills, and preferably a degree of reading skills, it is less effective with younger children for whom legal documents such as "birth certificates" are without significance.

However, even a pre-verbal child would appreciate and personally relate to the "birth" of a stuffed toy right before the child's eyes. Personalization of the toy would follow the vision of a limp figure (i.e., an unstuffed toy) coming to life as the unstuffed form becomes stuffed and swells to assume the final configuration and dimensions of the stuffed toy, right before the child's eyes, and then the "live" stuffed toy being delivered directly to the child for nurturing.

Accordingly, it is an object of the present invention to provide a method of making a personalized stuffed toy for a purchaser.

Another object is to provide such a method which in one preferred embodiment will provide personalization of import even to a pre-verbal child purchaser.

A further object is to provide such a method wherein in one preferred embodiment the unstuffed toy is formed at one site and transported unstuffed to a remote site containing the stuffing apparatus.

It is also an object of the present invention to provide such a method, which in one preferred embodiment is safe and economical and results in a safe stuffed toy.

It is another object to provide in one preferred embodiment a safe stuffed toy which precludes access by a child to the stuffing material, even when the stuffing aperture is partially or fully reopened.

SUMMARY OF THE INVENTION

It has been found that the above and related objects of the present invention are obtained in a method of making a personalized stuffed toy for a purchaser. The method comprises the steps of providing a plurality of fabric members fastened together so as to define a container which encloses an interior volume and which has an exterior surface defining a shape of the toy. The container further includes a stuffing opening in communication with the interior volume, actuatable means secured to the container adjacent the opening for closing the opening upon actuation, a flexible conduit means secured to the container adjacent the opening for providing communication between the opening and the interior volume, and actuatable blocking means for blocking the conduit means upon actuation. Also, provided is a stuffing apparatus having an injection tube and means for propelling a stuffing material through the injection tube. The conduit means is inserted over the injection tube. The toy is personalized by stuffing it in the presence of a purchaser thereof by injection stuffing the stuffing material into the interior volume through the injection tube, thereby to cause the container to assume the shape of the stuffed toy. The conduit means is then withdrawn from the injection tube. The blocking means is actuated to block the conduit means, and the closing means is actuated to close the opening, thereby to retain the stuffing material in the interior volume. Finally, the personalized stuffed toy is delivered to the purchaser.

Preferably the toy is further personalized by also performing in the presence of the purchaser the inserting and withdrawing steps. Preferably the container is formed at one site and transported unstuffed to a remote site containing the stuffing apparatus.

In a preferred embodiment, the closing means is soft and flexible and releasably closes the opening upon actuation. Optimally, the closing means is VELCRO comprising a multi-microhook portion and an opposed multi-microloop portion.

In another preferred embodiment, the blocking means is an untensioned, loose lock-stitch, and the means for actuating the blocking means is a portion of the lock-stitch for tensioning the same—e.g., a filament. The blocking means is actuated by pulling the filament, the filament optimally being knotted after pulling. Thus, the actuated blocking means blocks the conduit means, thereby to retain the stuffing material in the interior volume even if the opening is reopened.

The present invention additionally encompasses a toy ready for stuffing comprising a plurality of fabric members fastened together so as to define a container which encloses an interior volume and which has an exterior surface defining the shape of the toy. A stuffing opening in the container is in communication with the interior volume, and actuatable closing means, secured to the container adjacent the opening, are provided for releasably closing the opening upon actuation. Flexible conduit means, secured to the container adjacent the opening, provides communication between the opening and the interior volume, and actuatable blocking means, secured to the conduit means are provided for blocking the conduit means upon actuation. Thus, after stuffing material is introduced into the interior volume, the actuated blocking means blocks the conduit means, and the actuated closing means closes the opening, thereby to cause the stuffing material to be retained in the interior volume. The stuffed toy is safe, as the stuffing material is retained in the interior volume even if the opening is reopened.

BRIEF DESCRIPTION OF THE DRAWING

The above and related objects, features and advantages of the present invention will be more fully understood by reference to the following detailed description of the presently preferred, albeit illustrative, embodiments of the present invention, when taken in conjunction with the accompanying drawing wherein.

DETAILED DESCRIPTION OF THE PREFERRED EMBODIMENT

Figure 1:
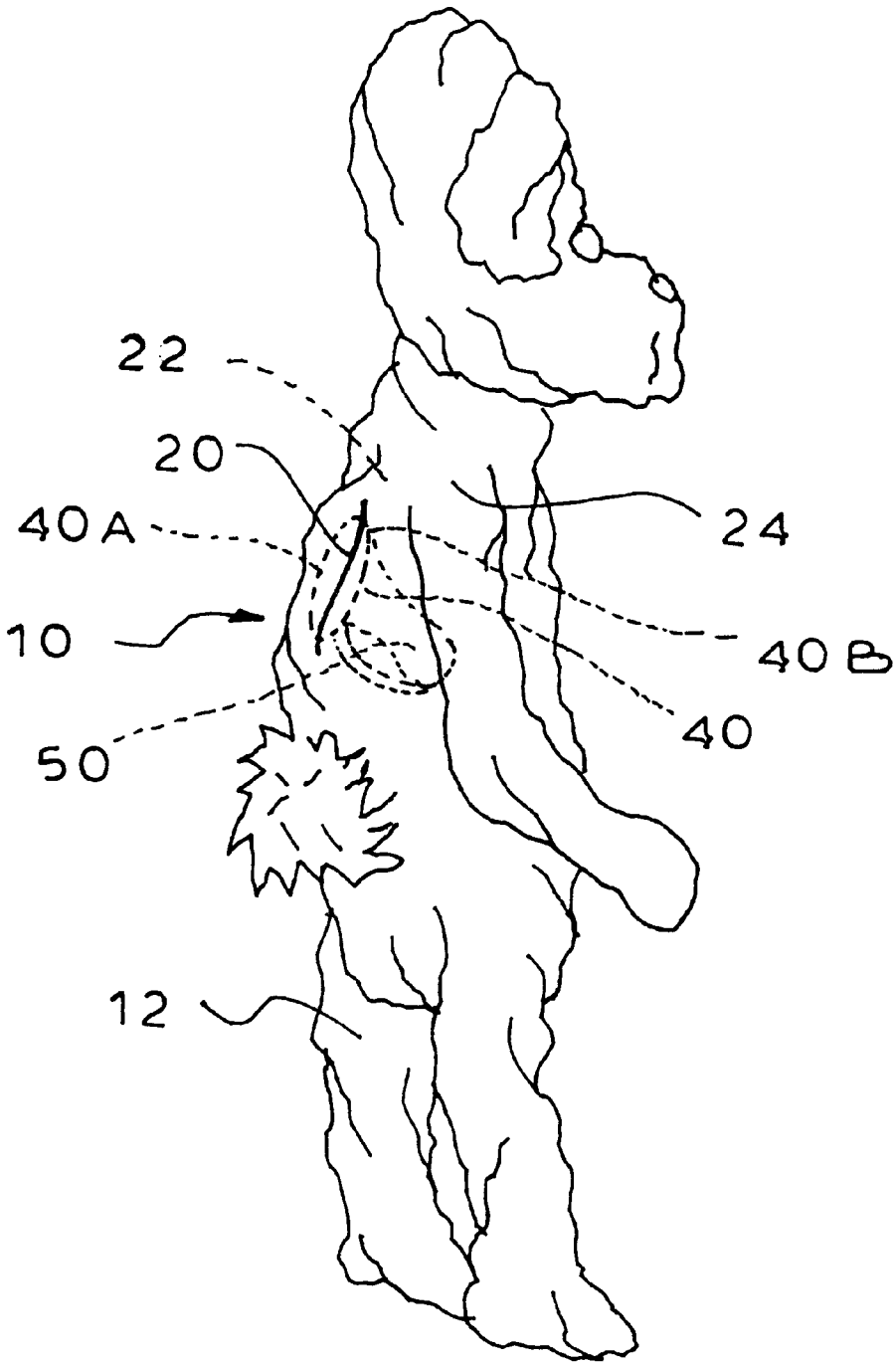
FIG. 1 is an isometric view of the unstuffed toy.

Referring now to the drawing, and in particular to FIG. 1 thereof, therein illustrated is an unstuffed toy according to the present invention, generally designated by the reference numeral 10. As illustrated, the toy 10 is designed to eventually become a stuffed bear (best seen in FIG. 3), but for the present toy 10 is either wholly or partially unstuffed. The unstuffed toy 10 is essentially a sewn fabric skin or container 12 adapted to be filled with a resilient stuffing material such as polyester-cellulose fibers and/or polystyrene beads or other filler materials. The skin or container 12 is typically assembled from multiple fabric members which are sewn together inside out, so that the raw, thick-type scar edges of the fabric seams are on the inside of the skin. A slit-like stuffing opening 20 is left for subsequently filling the skin 12 with the stuffing material. The stuffing opening 20 is usually part of a seam (so that it is less noticeable in the final stuffed toy), but may be formed elsewhere on the skin. The skin 12 is then turned right side out, ready for filling with the stuffing material through the stuffing opening 20.

Figure 2:
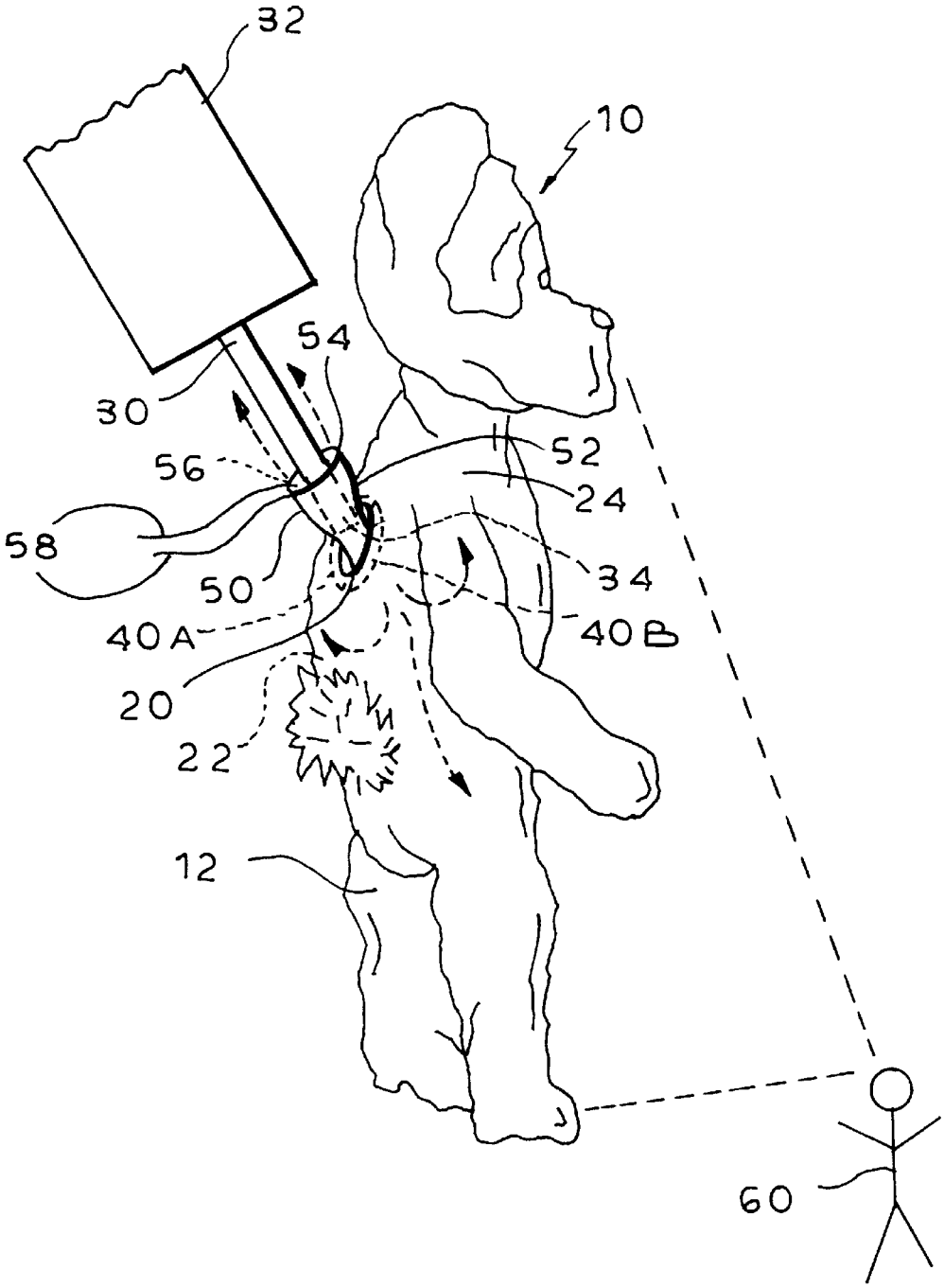
FIG. 2 is an isometric view of the partially stuffed toy in the process of being further stuffed according to a preferred procedure while the purchaser (represented as a small stick figure) watches.

The skin 12 of the toy 10 can be thought of as a container. The container encloses an interior volume 22 and has an exterior surface 24 which defines the shape of the toy 10. For the illustrated bear, this exterior surface 24 is preferably a cosmetic fur-covered surface. The stuffing opening 20 communicates with the interior volume 22 of the container 12, thereby allowing stuffing material to be inserted therein.

Where the toy 10 is to be stuffed manually, the length of the slit-like stuffing opening 20 is preferably several inches (4–6 inches in length) to facilitate the manual stuffing operation. On the other hand, where stuffing apparatus of the type illustrated in FIG. 2 is used—that is, an injection tube 30 and a device 32 for propelling stuffing material through the injection tube 30—the slit-like stuffing opening 20 may be shorter (preferably only about 2–3 inches in length). Injection tubes 30 come in various sizes, but are typically in the range of 1–4 inches in diameter, and are typically somewhat flexible at least adjacent the free end 34 thereof.

Figure 3:
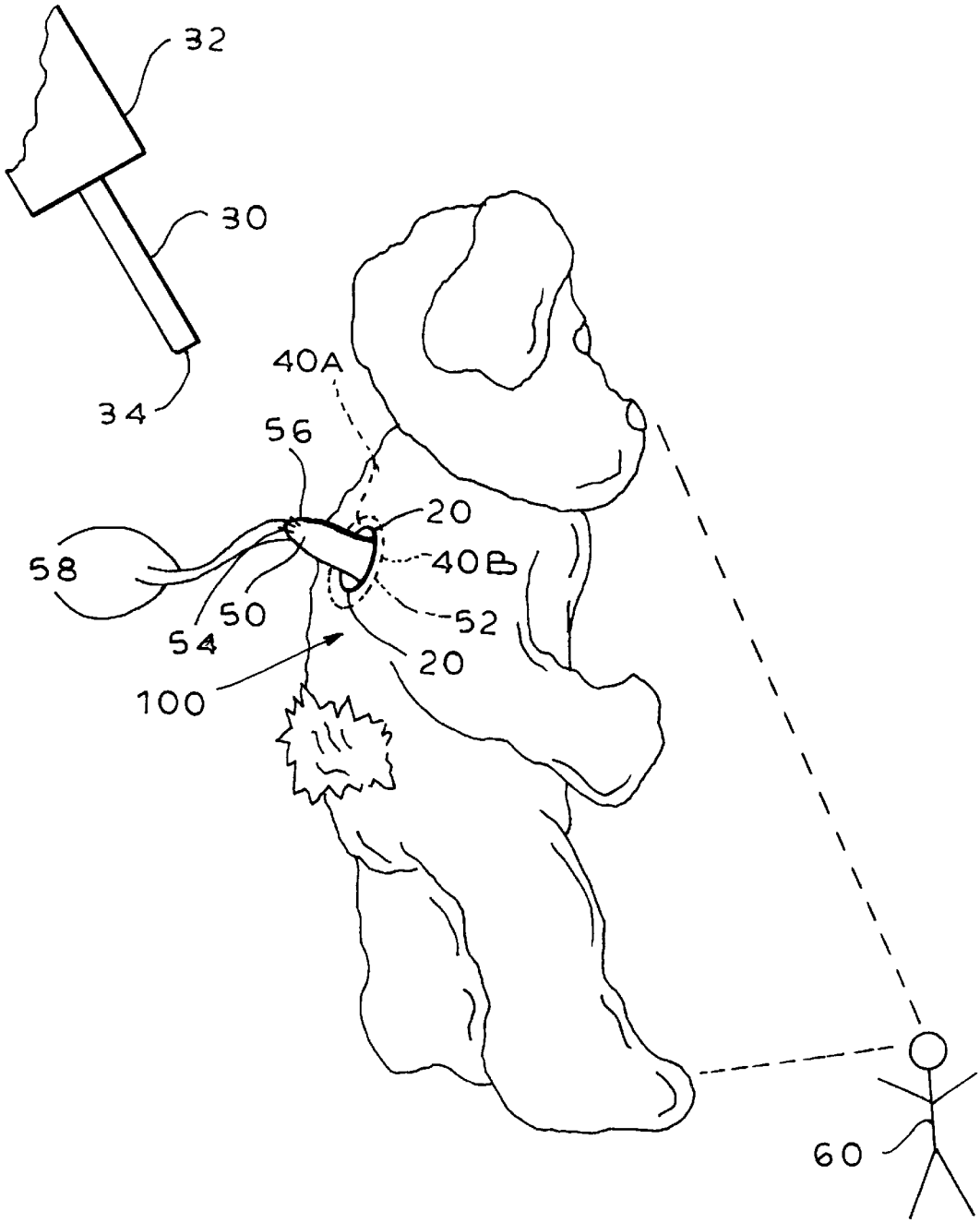
FIG. 3 is an isometric view of the fully stuffed toy separated from the injection apparatus, with the conduit means exposed, but blocked.

To avoid the conventional post-stuffing sewing step, an actuatable closing means 40 is secured to the container 12, adjacent the stuffing opening 20, for closing the opening 20 upon actuation. A preferred actuatable means 40 is a VELCRO fastener consisting of a pair of opposing portions, one portion 40A consisting of a multitude of microloops and the other portion 40B consisting of a multitude of microhooks adapted to be releasably engaged with the microloops. Each fastener portion 40A, 40B is preferably sewn to an opposed lip of the opening 20. In order to effect closure of the opening 20, as best seen in FIG. 3, it is only necessary for the two opposing fastener portions 40A, 40B to be manually pressed into engagement. The VELCRO-type closing means 40 is relatively soft and flexible, as necessary since it win be immediately adjacent the opening 20 and thus the exterior surface 24 of the stuffed toy.

Because the VELCRO-type fastener 40 is releasable, the stuffing opening 20 is further provided with a conduit 50 formed of a fabric impermeable to the stuffing material, such as tightly woven cloth or linen. Preferably one end 52 of the conduit 50 is secured to the opening 20, preferably by the same stitching used to secure the VELCRO portions 40A, 40B to the lips of the opening 20. The flexible conduit 50 thus has one end 52 secured to the toy 10 adjacent the opening 20, while the other or free end 54 provides communication between the opening 20 and the interior volume 22. The free end 54 includes actuatable blocking means 56 for blocking the conduit 50 upon actuation. The blocking means 56 may be, for example, a plastic or metal zipper or any like mechanism capable of closing the conduit free end 54 and thereby blocking the passage of stuffing material through the conduit 50. As the blocking means 56 is disposed within the interior volume 22 and therefore spaced from the exterior surface 24 of the stuffed toy, it is not necessarily a soft, flexible mechanism.

However, as illustrated in FIGS. 2 and 3, preferably the blocking means 56 is an untensioned, loose lock-stitch. A free filamentary portion or filament 58 of the lock-stitch is provided for actuating the blocking means 56—that is, for tensioning the lock-stitch. For example, the blocking means 56 may easily be actuated by pulling of the filament 58. Preferably, after pulling, the filament 58 is knotted and trimmed, if necessary, to remove the excess filament The actuated blocking means 56 blocks the conduit 50, thereby to retain the stuffing material in the interior volume 22 of the stuffed toy even if the aperture 20 becomes partially or wholly reopened. The actuatable blocking means 56 for blocking the conduit 50 may be actuated prior to actuation of the closing means 40 for closing the stuffing opening 20 or thereafter—for example, by the filament 58 extending through the conduit 50 and the closed stuffing opening 20 so that the filament 58 may be pulled (tensioned), despite the closed stuffing opening 20, in order to actuate the blocking means 56.

The unstuffed toy 10 may have certain segments thereof pre-stuffed so that the nature of the stuffed toy (e.g., its bear-like characteristics) may be appreciated by a potential purchaser. Thus, the head and face of the toy 10 may be pre-stuffed by the manufacturer prior to transport of the partially pre-stuffed toy from its place of manufacture to the retailer (where the partially pre-stuffed toy 10 becomes fully stuffed) or by the retailer for pre-sale display purposes. Preferably the unstuffed or partially pre-stuffed toy is transported from the manufacturer to the retailer with the conduit 50 within the interior volume 22 and the stuffing opening 20 closed to avoid any breakage or premature actuation of the blocking means 56.

Referring now to FIG. 2, therein illustrated is a stuffing apparatus 32 including an injection tube 30, a partially stuffed toy 10, and the purchaser/child 60 who will view the stuffing procedure by which the toy will be brought to life. For the purposes of explication of the present invention, no distinction will be made herein between the legal purchaser (who may be a child's parent) and the beneficial owner of the toy—namely, the child who will view the stuffing procedure.

Once an unstuffed (or partially pre-stuffed) toy 10 is selected and purchased, it is brought over to a conventional stuffing apparatus 32 designed to blow stuffing material through the injection tube 30. The stuffing aperture 20 is then opened by manually separating the fastener portions 40A and 40B, if necessary to expose the conduit 50. In a preferred procedure, the conduit free end 54 is then inserted over the free end 34 of the injection tube 30. If necessary, after the fastener 40 is opened, the free end 54 of conduit 50 is pulled out of the interior volume 22 through the stuffing opening 20 so that it is available for insertion over the injection tube free end 34. As the blocking means 56 at the conduit free end 54 has not yet been actuated, the conduit free end 54 will easily fit over the injection tube free end 34 so that the latter can feed the stuffing material into the interior volume 22 via the conduit 50. At this point the injection apparatus 32 is turned on, and the stuffing material is injected through injection tube 30, via conduit 50, into the interior volume 22.

Figure 2A:
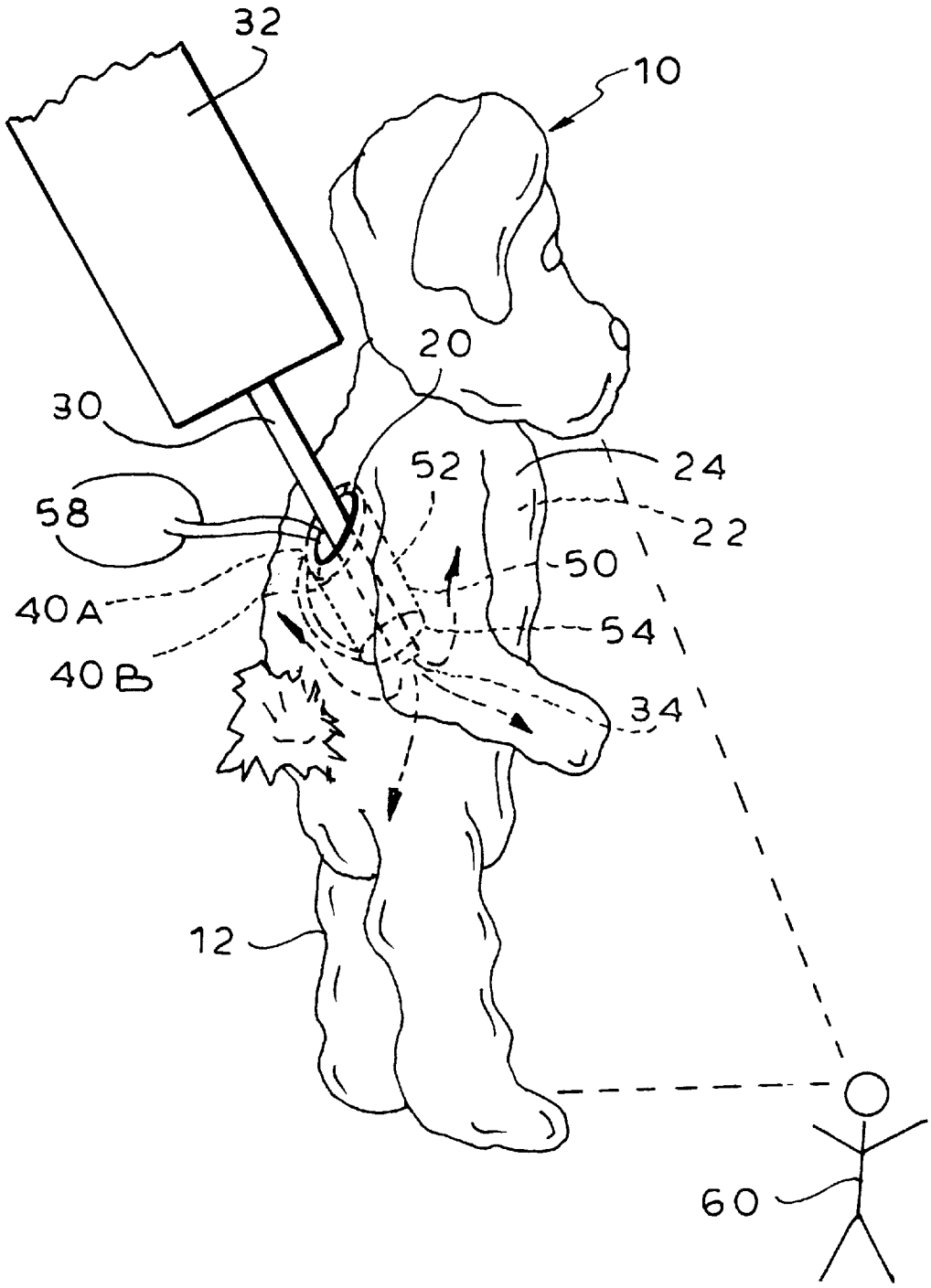
FIG. 2A is an isometric view of the partially stuffed toy in the process of being further stuffed according to an alternative procedure while the purchaser (represented as a small stick figure) watches.

Referring now to FIG. 2A, in an alternative procedure for stuffing the toy, the stuffing opening 20 is opened, if necessary, and the injection tube free end 34 is inserted through the stuffing opening 20 and through the conduit free end 54 while it is disposed within the interior volume 22. The injection apparatus 32 is then turned on, and the stuffing material is introduced into the interior volume 22 directly from the injection tube free end 34 which projects outwardly from the conduit free end 54 into the interior volume 22. The toy 10 may be moved about on the injection tube free end 34, the injection tube free end 34 may be moved about within interior volume 22, or both, to direct the stuffing material to the appropriate segments of the interior volume 22—for example, the extremities of the arms, legs, and head—as necessary to produce the fully stuffed toy, generally designated 100.

In either procedure, the purchaser 60 has an opportunity to see the limp unstuffed or only partially pre-stuffed toy 10 come to life as the stuffing material fills out the interior volume 22 and causes the skin 12 to assume the configuration and dimensions predetermined by the exterior surface 24 of the container. In emotional bonding terms, the effect upon the purchaser 60 of viewing this stuffing is hopefully comparable to that upon a father of watching his child emerge from his wife's womb during the birthing process. It is a matter of choice or preference whether the purchaser 60 is also given an opportunity to view the establishment of a connection between the injection tube free end 34 and the interior volume 22 (as illustrated in FIG. 2) and/or the separation of the injection tube free end 34 and the fully stuffed toy 100 (as illustrated in FIG. 3).

Referring now to FIG. 3, therein illustrated is the fully stuffed toy 100 after the injection apparatus 32 (illustrated in phantom line) and the fully stuffed toy 100 have been separated. Additionally, the blocking means 56 of the conduit 50 has been actuated. For example, in the preferred embodiment illustrated, the filament or filamentary portion 58 of the lock-stitch constituting the blocking means 56 has been pulled, tensioned and preferably knotted (followed by trimming, if necessary).

Figure 4:
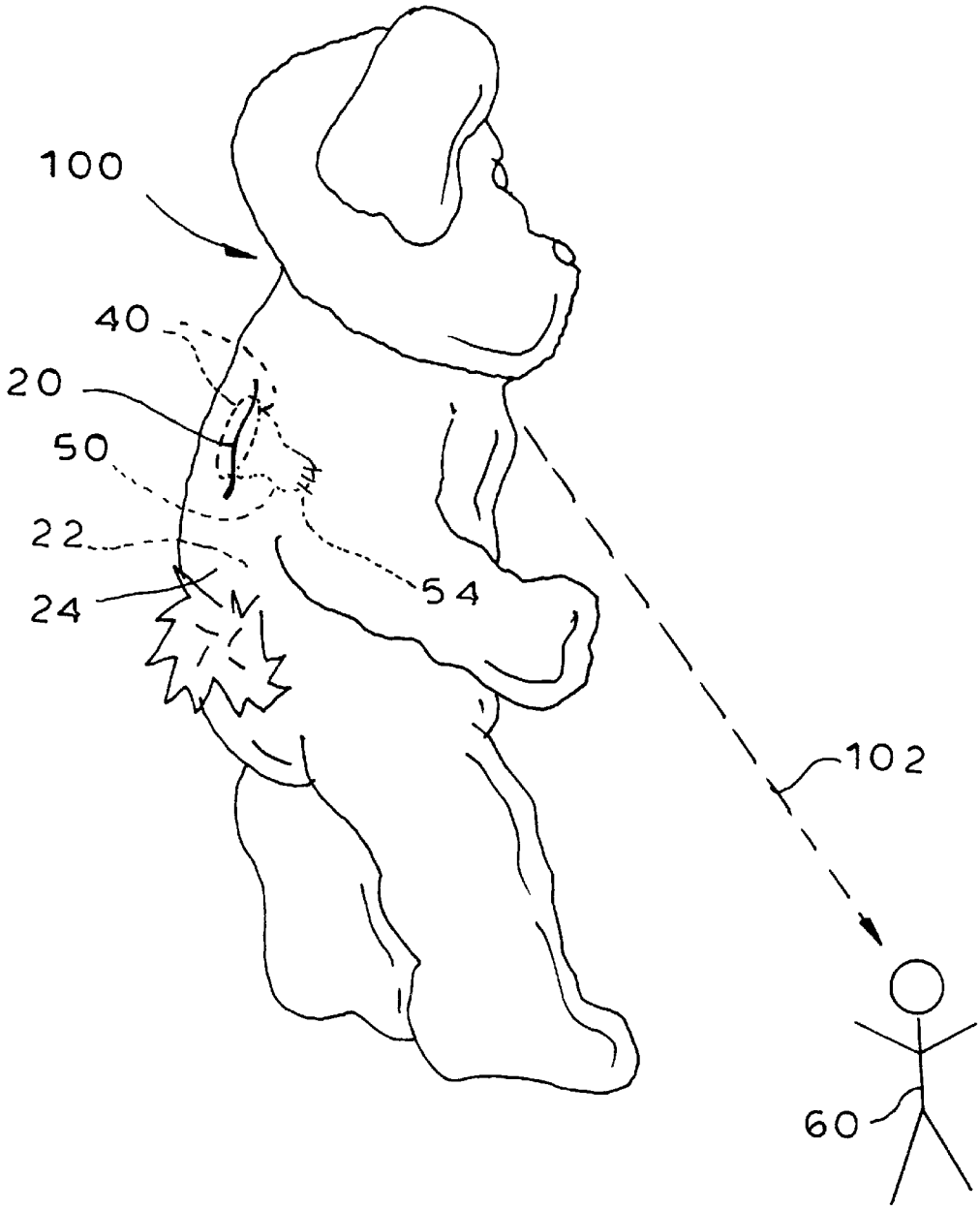
FIG. 4 is an isometric view showing eventual delivery of the stuffed toy to the purchaser after closing of the stuffing opening.

Referring now to FIG. 4 in particular, if the conduit 50 extended out of the interior volume 22 during the preferred stuffing procedure, it is then stuffed into the interior volume 22, as illustrated in FIG. 4, with care being taken that none of the stuffing material resides on the interior of the conduit 50. If the conduit 50 was within the interior volume 22 during the alternative stuffing procedure, it may simply be left in place. Alternatively, if desired, to facilitate the blocking operation the conduit free end 54 which was in the interior volume 22 during the alternative stuffing procedure may be temporarily withdrawn therefrom in order to facilitate actuation of the blocking means 56 and then returned thereto.

In any case, the opposing fastener portions 40A, 40B are finally pressed together to close the stuffing opening 20. At this point, the fully stuffed toy 100 is safe for delivery to the purchaser 60 since the blocked conduit means 50 acts as a safety barrier to maintain the stuffing material within the interior volume 22, even if the stuffing opening 20 is accidentally reopened, in whole or in part, during subsequent play. As indicated by the dashed arrow 102, the fully stuffed toy 100 is then delivered to the purchaser 60.

While the conduit 50 may indeed act as a conduit by enabling the stuffing material or the injection tube free end 34 to pass into the interior volume 22, its primary function is as a safety barrier. Accordingly, the conduit 50 need not be tubular in configuration or of any particular length. Indeed, it may be relatively short in length and lie almost flat against the interior surface of the skin or container 12, yet still perform its function as a safety barrier once blocked.

To summarize, the present invention provides a method of making a personalized stuffed toy for a purchaser, the personalization being of import even to a pre-verbal child-purchaser. The unstuffed toy may be formed at one site and transported unstuffed to a remote site containing the stuffing apparatus. The method is safe and economical and results in a safe stuffed toy. Additionally, the present invention provides a safe stuffed toy wherein there is a safety barrier as a back-up for the closed stuffing opening.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A method of making a personalized stuffed toy for a purchaser, comprising the steps of:

(A) providing a plurality of fabric members fastened together so as to define a container which encloses an interior volume and which has an exterior surface defining a shape of the toy, the container further including (i) a stuffing opening in communication with the interior volume;

(ii) actuatable closing means, secured to the container adjacent the opening, for closing the opening upon actuation;

(iii) flexible conduit means, secured to the container adjacent the opening, for providing communication between the opening and the interior volume; and (iv) actuatable blocking means for blocking the conduit means upon actuation;

(B) providing a stuffing apparatus having an injection tube and means for propelling a stuffing material through the injection tube;

(C) providing communication between the conduit means and the injection tube;

(D) personalizing the toy by stuffing it in the presence of a purchaser thereof by injection stuffing the stuffing material into the interior volume through the injection tube, thereby to cause the container to assume the shape of the stuffed toy;

(E) separating the conduit means and the injection tube;

(F) actuating the blocking means to block the conduit means, and actuating the closing means to close the opening, thereby to retain the stuffing material in the interior volume; and (G) delivering the personalized stuffed toy to the purchaser.

2. The method of claim 1 wherein the toy is further personalized by also performing in the presence of the purchaser the inserting and withdrawing steps.

3. The method of claim 1 wherein the closing means is soft and flexible.

4. The method of claim 3 wherein the closing means releasably closes the opening upon actuation.

5. The method of claim 4 wherein the closing means comprises a multi-microhook portion and an opposed multi-microloop portion.

6. The method of claim 1 wherein the blocking means is an untensioned, loose lock-stitch, and the means for actuating the blocking means is a portion of the lock-stitch for tensioning the same.

7. The method of claim 6 wherein the means for actuating the blocking means is a filament.

8. The method of claim 7 wherein the blocking means is actuated by pulling the filament.

9. The method of claim 8 wherein the filament is knotted after pulling.

10. The method of claim 1 wherein the actuated blocking means blocks the conduit means, thereby to retain the stuffing material in the interior volume even if the opening is reopened.

11. The method of claim 1 wherein the container is formed at one site and transported unstuffed to a remote site containing the stuffing apparatus.

12. The method of claim 1 wherein the closing means is soft and flexible and releasably closes the opening upon actuation.

13. The method of claim 1 wherein the blocking means is an untensioned, loose lock-stitch, and the means for actuating the blocking means is a filament of the lock-stitch for tensioning the same, the blocking means being actuated by pulling and knotting the filament such that the actuated blocking means blocks the conduit means, thereby to retain the stuffing material in the interior volume even if the opening is reopened.

14. The method of claim 1 wherein the conduit means is inserted over a free end of the injection tube to provide communication between the injection tube and the interior volume, and the conduit means and the injection tube are separated by removal of the conduit means from the injection tube.

15. The method of claim 1 wherein, prior to stuffing, the conduit means is extended outwardly from the interior volume through the opening, and, after stuffing, separation from the injection tube, and actuation of the blocking means, the conduit means is inserted into the interior volume through the opening prior to closing thereof.

16. A toy ready for stuffing, comprising:

(A) a plurality of fabric members fastened together so as to define a container which encloses an interior volume and which has an exterior surface defining a shape of the toy;

(B) a stuffing opening in said container in communication with said interior volume;

(C) actuatable closing means, secured to said container adjacent said opening, for releasably closing said opening upon actuation;

(D) flexible conduit means, secured to said container adjacent said opening, for providing communication between said opening and said interior volume; and (E) actuatable blocking means, secured to said conduit means, for blocking said conduit means upon actuation; whereby, after stuffing material is introduced into said interior volume, said actuated blocking means blocks said conduit means and said actuated closing means closes said opening, thereby to cause the stuffing material to be retained in said interior volume.

17. The toy of claim 16 wherein said closing means is soft and flexible.

18. The toy of claim 17 wherein said closing means comprises a multi-microhook portion and an opposed multi-microloop portion.

19. The toy of claim 16 wherein said blocking means is an untensioned, loose lock-stitch, and said means for actuating said blocking means is a portion of the lock-stitch for tensioning the same.

20. The toy of claim 19 wherein said means for actuating said blocking means is a filament.

21. The toy of claim 20 wherein said blocking means is actuatable by pulling and knotting said filament.

22. The toy of claim 16 wherein said blocking means is an untensioned, loose lock-stitch, and said means for actuating said blocking means is a filament of said lock-stitch for tensioning the same, said blocking means being actuated by pulling and knotting said filament such that said actuated blocking means blocks said conduit means, thereby to retain the stuffing material in the interior volume even if said opening is reopened.

23. The toy of claim 16 after stuffing, wherein said interior volume is substantially filed with stuffing material, said blocking means is actuated to block said conduit means, and said closing means is actuated to releasably close said opening, whereby said blocked conduit means serves as a safety barrier between the stuffing material and said closed aperture.

24. The toy of claim 16 wherein said conduit means is configured and dimensioned for insertion over a free end of an injection tube to provide for passage of stuffing material from the injection tube into said interior volume via aid conduit.

25. The toy of claim 24 wherein said conduit means is configured and dimensioned to be extended outwardly from said interior volume through said opening prior to stuffing and, after stuffing, separation from the injection tube, and actuation of said blocking means, to be inserted into said interior volume through said opening prior to actuation of said closing means.

* * * * *